United States Patent [19]

Boyko

[11] 3,998,202

[45] Dec. 21, 1976

[54] BOWSTRING RELEASE DEVICE

[76] Inventor: Frank E. Boyko, 806 DeSale St., Vienna, Va. 22180

[22] Filed: Aug. 4, 1975

[21] Appl. No.: 601,404

[52] U.S. Cl. ..... 124/35 A

[51] Int. Cl.[2] ..... F41C 19/00

[58] Field of Search ..... 124/35 A, 24 R, 23 R, 124/41, 37

[56] References Cited

UNITED STATES PATENTS

| | | | |
|---|---|---|---|
| 2,417,791 | 3/1947 | Tyszkiewicz | 124/35 A |
| 2,758,585 | 8/1956 | Fields | 124/37 X |
| 2,819,707 | 1/1958 | Kayfes et al. | 124/35 A |

*Primary Examiner*—Richard J. Apley
*Assistant Examiner*—William R. Browne

[57] ABSTRACT

A bowstring pulling and release device comprises a one-piece, T-shaped body including a handle portion forming the crossbar of the T-shaped body and a leg portion extending outwardly from the handle portion and terminating in an outer free end portion. A bowstring receiving notch is formed in the free end portion and a transverse slot is formed in the free end portion normal to the bowstring receiving notch. A lock is pivotally mounted in the transverse slot for releasably locking the bowstring in the notch. An enlarged bore extends longitudinally through the leg portion from the transverse slot into the handle portion, and a reduced bore extends from the enlarged bore through the handle portion. A latch pin is slidably mounted in the enlarged bore and is spring biased outwardly into the transverse slot. The latch pin has a latch detent at its end which extends outwardly into the transverse slot and a longitudinal extension at its other end which extends through the reduced bore. A release lever is pivotally mounted along side of the handle portion opposite from the leg portion and is adjustably connected to the longitudinal extension of the latch pin for retracting the latch pin from the transverse slot. The pivoted lock has an abutment engagable with the latch detent for securing the lock in latched position and retaining the bowstring until the latch pin is retracted by operation of the release lever.

6 Claims, 6 Drawing Figures

BOWSTRING RELEASE DEVICE

BACKGROUND OF THE INVENTION

1. Field of the Invention

The invention relates to an improved bowstring pulling and release device for use in archery.

2. Background of the Invention

Various devices for holding an arrow and drawing a bowstring are known in the prior art. However the prior art devices vary greatly in complexity and ease of operation.

SUMMARY OF THE INVENTION

It is an object of this invention to provide an improved bowstring pulling and release device which is simple in construction and is economical in its manufacture. The device provides for smooth arrow release and delivery with accompanying improved accuracy. It enables the shooting of heavier poundage bows by persons who without the device of this invention could not use bows of like poundage. The device may be used in either hand of the archer in a natural shooting position and is not restricted to right or left hand operation.

The device comprises a generally T-shaped body which may be formed by a molding operation, a pivoted captivator lock member, a sliding spring biased latch pin for latching the lock member in a positive locked position, and a pivoted release lever connected to the latch pin which is adjustable for retraction with a selected degree of sensitivity.

The device is self-cocking upon pushing the device against a bowstring with slight pressure and does not require manual manipulation of its parts to perform the cocking operation.

The shape and construction of the invention permits the device to be held close to the face of the user at the individual's preferred string anchor position without danger of injury.

The invention eliminates the need for special shooting gloves and tabs so that any type of gloves may be used and reduces finger tension with its accompanying unsteadiness of hand. By using the invention, blisters which result from string and finger contact are avoided.

The invention facilitates the use of shorter arrows than usually employed in archery.

BRIEF DESCRIPTION OF THE DRAWING

With the foregoing objects and features in view and such other objects and features which may become apparent as the specification proceeds, the invention will be understood from the following description taken in conjunction with the accompanying drawing, wherein like characters of reference designate like parts and wherein.

DESCRIPTION OF THE PREFERRED EMBODIMENT

Figures 1, 2, 3, 4, 5, 6:
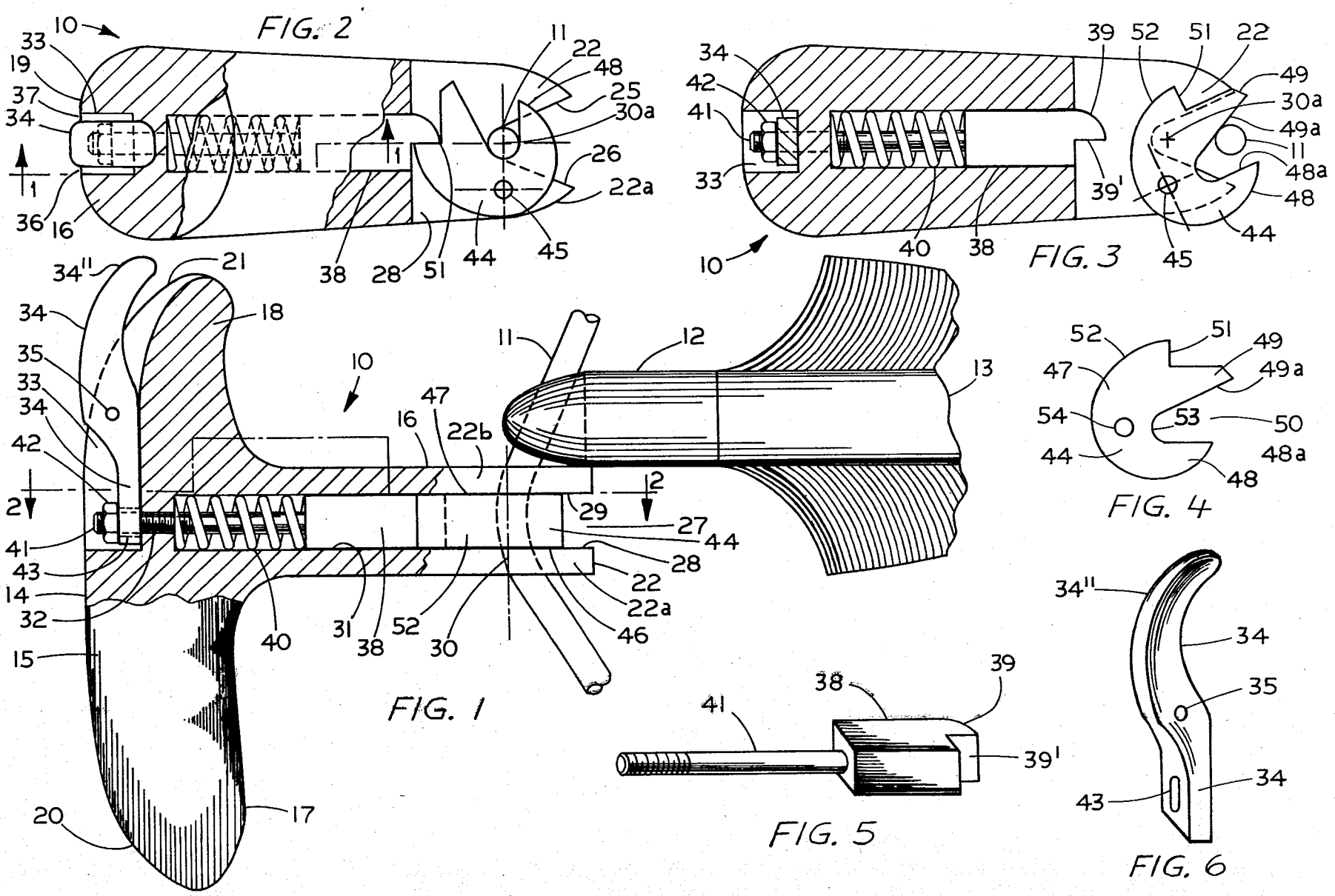
FIG. 1 is a side elevational view of the invention with a portion thereof shown in section taken along the line 1—1 in FIG. 2.
FIG. 2 is a partial sectional view taken along the line 2—2 in FIG. 1 showing the bowstring captivator lock member in locked position.
FIG. 3 is a cross sectional view through the invention showing the captivator lock member in open position.
FIG. 4 is a top plan view of the captivator lock member separated from the body of the invention.
FIG. 5 is a perspective view of the latch pin of the invention.
FIG. 6 is a perspective view of the release lever of the invention.

Referring now to the drawing, the bowstring pulling and releasing device 10 of this invention is shown engaging a bowstring 11 against which the nock 12 of an arrow 13 is seated (the bowstring and arrow being only partially shown). The invention 10 comprises a generally T-shaped body 14 including an elongated handle portion 15 providing the crossbar of the T-shaped body and an integral elongated leg portion 16 extending substantially normal to the handle portion intermediate the opposite handle end portions 17 and 18. The handle portion 15 is shaped to fit in the palm of a person's hand, being generally rounded in cross section so that the person's fingers may close around the handle with the person's thumb extending outwardly along the rear side 19 of the handle portion 15 and over the end of the handle end portion 18. The handle end portions 17 and 18 are curved generally forwardly from their rear sides over their ends as shown at 20 and 21 respectively in FIG. 1.

The leg portion 16 tapers slightly forwardly from the handle portion 15 to a free end portion 22 opposite the handle portion. A bow string receiving notch 23 is provided at the end of the free end portion 22. As seen in FIGS. 2 and 3, the notch 23 opens outwardly and divergently and is symetrical with respect to a medial plane extending through the elongated handle portion and leg portions normal to the plane of the drawing. A curved inner surface 24 at the inner end of the generally V-shaped notch 23 has a center of curvature **30*a* which is located along a center line 30 (see FIG. 1) located within the aforesaid medial plane. The radius of curvature of the surface 24 is substantially equal to the radius of the bowstring 11 so that the bowstring will not bind between the outwardly diverging walls 25 and 26 bounding the notch 23. A transverse slot 27 extends entirely across the free end portion 22 from the free end of the leg 16 rearwardly toward the handle portion 15 and separates the end portion 22 into a pair of spaced parallel end members 22*a* and 22*b*. The end members 22*a* and 22*b* have planar inner surfaces 28 and 29 respectively which are normal to the aforesaid medial plane and centerline 30. An enlarged square cross-sectioned bore 31 extends longitudinally and centrally through the leg portion 16 from the transverse slot 27 inwardly into the handle portion 15. A reduced cylindrical bore 32 extends coaxially from the inner end of the enlarged square bore 31 into a rearwardly open slot 33 formed longitudinally along the rear side of the handle end portion 18 from an inner position intermediate the ends of the handle portion. The slot 33 receives a release lever 34 which has an inner end 34' and an outer finger piece 34'' and is pivoted intermediate its ends by a pivot pin 35 mounted between the parallel walls 36 and 37 of the slot 33**.

A latch pin 38 is slidably mounted within the enlarged square bore 31 and is biased outwardly into the transverse slot 27 by a compression spring 40 interposed between the inner end of the latch pin 38 and the inner end of the bore 31. The latch pin 38 has a latch detent 39 at its outer end and a threaded shaft portion 41 extending rearwardly through the reduced bore 32 into the release lever receiving slot 33. The threaded shaft portion 41 extends through a slotted aperture 43 provided at the inner end 34' of the release lever 34 and is adjustably secured with respect to the release lever 34 by a lock nut 42. By tightening or loosening the nut 42, the travel of latch face surface 39′ of latch pin detent 39 is adjustable against latch shoulder surface 51 of captivator lock member 44 to provide a greater or lesser sensitive release.

A bowstring captivator lock member 44 is pivotally mounted within the transverse slot 27 by a pivot pin 45. The captivator lock member 44 has opposite planar faces 46 and 47 which slide contiguous to the inner planar surfaces 28 and 29 respectively of the end members 22*a* and 22*b*, a hook portion 48, a cocking portion 49, a bowstring receiving opening 50 between the hook portion and cocking portion, and a latch shoulder 51 opposite the hook portion. A smoothly curved cam surface is provided between the latch shoulder 51 and the hook portion 48 for camming the latch pin 38 rearwardly against the bias of the spring 40. The hook portion 48 has a straight inner edge surface 48*a* defining one side of the bowstring receiving opening 50, and the cocking portion 49 has an inner cocking edge surface 49*a* defining an opposite side of the bowstring receiving opening. Located between the surfaces 48*a* and 49*a* is an inner curved surface 53. The inner surface 48*a* and the latch shoulder 51 extend in directions normal to each other. A cylindrical bore 54 extends through the captivator member 44 at a position intermediate the curved surfaces 52 and 53 and receives the pivot pin 45 therein with a sliding fit. The pivot pin 45 projects from opposite sides of the bore 54 perpendicularly to the planar surface 46 and 47 and is pressed into the end members 22*a* and 22*b*. The axis of the pivot pin 45 is located to one side of the aforesaid medial plane extending through the body 14 of the bowstring pulling and release device and is parallel to the center line 30 through the center of curvature 30*a* of the inner surface 24.

FIGS. 2 and 3 respectively show the closed and open positions of the bowstring captivator lock member 44. Looking first at FIG. 3, the lock member 44 is seen in its open position. for either releasing the bowstring 11 after it has been pulled taut, or for receiving the bowstring prior to cocking the bowstring pulling and release device. FIG. 2 shows the lock member 44 after it has been pivoted counterclockwise from the position shown in FIG. 3 until the latch shoulder 51 engages in face to face contact with the latch face 39′ of the latch pin detent 39, the bowstring 11 being captured within the notch 23 by the hook portion 48 which closes the notch.

In operation, an archer will grasp the device 10 with the handle portion 15 in the palm of either hand (depending on the natural handedness of the archer) and with the index and middle fingers straddling the leg potion 16 and the thumb extending along the release lever 34. The device 10 is then moved forward toward the bowstring until the bowstring enters the open notch 23 at the free end of the leg portion 16 and the opening 50 of the captivator lock member 44 as shown in FIG. 3. As the device 10 is pushed further forward in the direction of the bowstring 11, the bowstring engages the cocking edge 49*a* of the lock member 44 and forces the lock member 44 to pivot counterclockwise. Counterclockwise motion of the lock member 44 brings the cam surface 52 to bear against the latch detent 39 and then cams the detent rearwardly until the shoulder 51 passes the latch face 39′. The latch pin is then pushed forward by the spring 40 so that it seats against the latch shoulder 51 in the manner shown in FIG. 2. It will thus be seen that the device 10 is self-cocking as the device is pushed forward with slight pressure against the bowstring and it does not require manual cocking. With the bowstring captured within the notch 23 as shown in FIG. 2, the archer can then pull the device and bowstring rearwardly against the pressure of the bow (not shown) to any desired position, usually close to the archer's face. The nock of the arrow is engaged with the bowstring and rests against the upper surface of the free end portion 22 of the device 10. When the archer has taken aim and wishes to release the bowstring inorder to propel the arrow, the archer places his thumb against the release lever finger portion 34″ and pushes the finger portion 34″ inwardly toward the handle end portion 18. As the release lever 34 pivots, the latch pin 38 is drawn inwardly until the latch detent 39 is withdrawn from engagement with the latch shoulder 51 of the captivator lock member 44. The force of the bowstring will immediately pivot the released captivator lock member 44 clockwise until the hook portion 48 no longer closes the notch 23, whereupon the bowstring continues to move forward freely toward the bow and propels the arrow 13 toward its target.

The body 14 of the device 10 may be molded in one piece of suitable rigid materials such as plastics, especially nylon, and light metals. The lever 34, latch pin 38, captivator lock member 44 may likewise be molded.

What is claimed is:

1. A bowstring pulling and release device comprising a one piece, T-shaped body including an elongated handle portion providing the crossbar of said T-shaped body and being formed to be held vertically in one hand with fingers encircling the handle portion and with thumb extending upwardly along one side thereof, and a leg portion extending outwardly from the handle portion opposite said one side and terminating in an outer free end portion, a bowstring receiving notch formed in said free end portion, a transverse slot passing through said free end portion and the plane of said slot being normal to a string and locked bowstring receiving notch, lock means pivotally mounted in said transverse slot for releasably locking a bowstring in said notch, and enlarged bore extending longitudinally through said leg portion from said transverse slot into said handle portion, said leg portion being closed around said enlarged bore, a reduced bore extending from aid enlarged bore through said handle portion, a latch pin slidably mounted in said enlarged bore, said latch pin having a latch detent at one end and a longitudinal extension at its other end extending through said reduced bore, spring means within said enlarged bore for biasing said latch pin outwardly into said transverse slot, a release lever pivotally mounted along said one side of said handle portion opposite said leg portion, means for operatively connecting said release lever to said longitudinal extension of said latch pin for retracting said latch pin and limiting the motion of said latch pin toward said free end portion, aid lock means having an abutment engagable with said latch detent for securing said lock means in latched position for retaining a bowstring until said latch pin is withdrawn by operation of said release lever.

2. The device according to claim 1 wherein said means for operatively connecting said release lever to said longitudinal extension of said latch pin is adjustable for varying the limit to which said latch pin projects into said transverse slot.

3. The device according to claim 1 wherein said lock means includes a hook portion on the opposite side of said lock means from said abutment, a cocking portion, and a bowstring receiving opening between said hook portion and said cocking portion, said lock means being pivoted in said transverse slot on one side of said bowstring receiving notch and pivotable between an open position wherein said bowstring receiving opening opens outwardly with respect to said bowstring receiving notch to receive a bowstring within said opening and to simultaneously permit a bowstring to enter said notch and a locked position wherein said abutment is engaged by said latch detent and said hook portion extends across said notch to retain a bowstring in said notch.

4. The device according to claim 3 wherin said cocking portion is positioned to normally extend across said noteh in the open position of said lock means and is engagable with a bowstring whereupon an entrance of a bowstring into said notch pivots the lock means to its locked position.

5. The device according to claim 4 wherein said lock means has cam means extending from said abutment around one side for camming said latch pin inwardly into said enlarged bore as the lock means is pivoted from its open position to its locked position.

6. The device according to claim 1 wherein said T-shaped body is a molded single piece of rigid material.

* * * * *